US008132578B2

(12) United States Patent
LoPrete

(10) Patent No.: US 8,132,578 B2
(45) Date of Patent: Mar. 13, 2012

(54) SIFTER DISH INSERT FOR COSMETIC PACKAGE

(75) Inventor: Wayne J. LoPrete, Peekskill, NY (US)

(73) Assignee: ELC Management LLC, New York, NY (US)

( * ) Notice: Subject to any disclaimer, the term of this patent is extended or adjusted under 35 U.S.C. 154(b) by 227 days.

(21) Appl. No.: 12/404,427

(22) Filed: Mar. 16, 2009

(65) Prior Publication Data

US 2010/0012145 A1 Jan. 21, 2010

Related U.S. Application Data

(60) Provisional application No. 61/081,433, filed on Jul. 17, 2008.

(51) Int. Cl.

| | |
|---|---|
| ***A45D 33/02*** | (2006.01) |
| ***B65D 69/00*** | (2006.01) |
| ***B65D 47/00*** | (2006.01) |
| ***B65D 39/00*** | (2006.01) |
| ***B65D 41/00*** | (2006.01) |
| ***B65D 43/00*** | (2006.01) |
| ***B65D 51/00*** | (2006.01) |
| ***B65D 71/00*** | (2006.01) |
| ***A47J 43/22*** | (2006.01) |
| ***A47G 19/24*** | (2006.01) |
| ***B67D 7/76*** | (2010.01) |

(52) U.S. Cl. ..... 132/307; 206/581; 206/823; 209/371; 222/565; 222/189.02; 215/231

(58) Field of Classification Search ..... 132/307, 132/286, 293, 298, 299, 303, 305, 306, 295; 206/581, 823, 229, 235; 215/307, 308, 324, 215/329, 237, 227, 231; 15/229.14; 222/189.02, 222/189.03, 457.5, 490, 548, 540, 565, 480, 222/142.9, 492, 189.04, 189.05, 142.1, 142.4, 222/158, 424.5, 425, 441, 454, 456, 556, 222/562, 182; 220/522, 370, 371, 372; 209/371, 209/397

See application file for complete search history.

(56) References Cited

U.S. PATENT DOCUMENTS 456,709 A * 7/1891 Stoddard et al. ..... 222/425

(Continued)

FOREIGN PATENT DOCUMENTS

JP 08-131248 5/1996

(Continued)

OTHER PUBLICATIONS

PCT International Search Report; International Application No. PCT/US2009/049489; Completion Date: Feb. 4, 2010; Date of Mailing: Feb. 4, 2010.

(Continued)

*Primary Examiner* — Todd Manahan
*Assistant Examiner* — Vanitha Elgart
(74) *Attorney, Agent, or Firm* — Martin Haerter

(57) ABSTRACT

A sifter insert for the neck of a powder jar is secured above the product reservoir and below the cap of the jar. The insert has a central concave dish for supporting a quantity of powder product, and a channel around the perimeter of the dish. The insert is secured in the neck such that the dish is spaced below the bottom of the cap. Slots in the channel permit the flow of powder from the reservoir into the channel when the jar is inverted with the cap closed, and from the channel onto the dish when the inverted jar is righted. Powder in the dish is accessed by the user upon removal of the cap. The cap is then closed and the jar shaken to return excess powder from the dish to the reservoir through the slots in the channel.

6 Claims, 2 Drawing Sheets

U.S. PATENT DOCUMENTS

| | | | | | |
|---|---|---|---|---|---|
| 1,341,951 | A | * | 6/1920 | Turner | 222/545 |
| 1,558,964 | A | | 10/1925 | Clark | |
| 1,620,002 | A | * | 3/1927 | Barany | 132/298 |
| 1,620,088 | A | * | 3/1927 | Fairbairn | 132/298 |
| 1,656,878 | A | * | 1/1928 | Booty | 401/130 |
| 1,694,727 | A | * | 12/1928 | Allen | 132/299 |
| 1,695,677 | A | * | 12/1928 | Barany | 132/299 |
| 1,714,368 | A | * | 5/1929 | Hobson | 222/553 |
| 1,747,318 | A | * | 2/1930 | Pennock | 206/769 |
| 2,035,256 | A | * | 3/1936 | Ball | 132/315 |
| 2,304,531 | A | * | 12/1942 | Bloom et al. | 220/522 |
| 2,370,820 | A | | 3/1945 | Stott | |
| 3,265,255 | A | * | 8/1966 | Mitchell | 222/425 |
| 3,820,690 | A | * | 6/1974 | Musher | 222/490 |
| 4,144,989 | A | | 3/1979 | Joy | |
| 4,544,063 | A | * | 10/1985 | Neward | 206/540 |
| 5,487,494 | A | | 1/1996 | Robbins, III | |
| 5,495,964 | A | * | 3/1996 | Santagiuliana | 222/455 |
| 5,515,875 | A | * | 5/1996 | Acker et al. | 132/298 |
| 5,542,579 | A | | 8/1996 | Robbins, III | |
| 6,053,183 | A | | 4/2000 | Rizzo | |
| 6,202,902 | B1 | * | 3/2001 | Starr | 222/548 |
| 7,503,331 | B2 | * | 3/2009 | Eng et al. | 132/294 |
| 7,841,349 | B2 | * | 11/2010 | Bennett | 132/306 |
| 2002/0056660 | A1 | * | 5/2002 | Gueret | 206/525 |
| 2008/0092916 | A1 | | 4/2008 | Song | |
| 2009/0188518 | A1 | * | 7/2009 | Thorpe et al. | 132/307 |
| 2009/0205673 | A1 | * | 8/2009 | Richardson | 132/307 |
| 2010/0243684 | A1 | * | 9/2010 | McGuyer | 222/559 |

FOREIGN PATENT DOCUMENTS

| | | |
|---|---|---|
| KR | 20-0400078 | 11/2005 |
| KR | 20-0423018 | 8/2006 |
| KR | 10-0698407 | 3/2007 |
| WO | WO2007/139261 | 12/2007 |

OTHER PUBLICATIONS

PCT Written Opinion of the International Searching Authority, or the Declaration; International Application No. PCT/US2009/049489; Completion Date: Feb. 4, 2010; Mailing Date: Feb. 2, 2010.

* cited by examiner

SIFTER DISH INSERT FOR COSMETIC PACKAGE

This application claims priority from U.S. Provisional Patent Application No. 61/081,433 filed on Jul. 17, 2008.

BACKGROUND OF THE INVENTION

1. Field of the Invention

The present invention relates to sifter inserts for cosmetic product packages. Sifter inserts are generally suspended from the rim of a powder jar and serve to temporarily hold a small quantity of powder for access by the user. In particular, the present invention is directed to a sifter insert with a center dish portion and slots around the perimeter of the dish that permit transfer of powder to and from a product storage reservoir.

2. Description of the Prior Art

Referring to FIG. 2, prior art cosmetic powder packages, e.g., face powder, typically consist of a jar 1 made of plastic, metal or glass, with a threaded neck 4 and a plastic or metal cap 2 that can be threaded onto the neck 4 as a closure. The jar defines a product reservoir 7. The neck 4 defines an opening 8 that provides access to the reservoir 7. A plastic injection molded sifter 3 is friction-fitted into the opening 8 inside of the neck of the jar. A substantially flat top surface 5 of the sifter 3 is typically recessed below an upper edge 6 of the neck 4 so that a clearance 10 is created between the top surface 5 of the sifter 3 and a bottom side 11 of the cap 2. A plurality of small holes 9 in the top surface 5 allow the flow of powder (not shown) from the reservoir 7 through the sifter 3 into the clearance 10 when the jar 1 is inverted. With the cap 2 removed, the powder may be sprinkled directly onto the user's skin or onto an applicator, such as a powder brush or a powder puff, or the powder may be sprinkled into a separate dish or tray that a user can dip an applicator into. Alternatively, with the cap 2 secured to the neck 4 of the jar 1, the jar 1 can be inverted briefly to allow powder to flow through the holes 9 into the clearance 10. When the jar 1 is returned to the upright position, some of the powder remains on the top surface 5 of the sifter 3. The user can then remove the cap 2 to access the powder loaded on the on the top surface 5 of the sifter 3.

A problem with the prior art arrangement is that the user has limited control with respect to the amount of product that is deposited onto the top surface of the sifter. In addition, during use powder held on the top surface 5 of the sifter 3 tends to fall through the holes 9 back into the product reservoir 7, which may in turn leave insufficient quantities of powder accessible to the user. To improve access to the powder in the jar, some users even go so far as to remove the sifter from the neck. The user can then insert an applicator into the product reservoir to retrieve product, or the user can dump powder from the jar into the cap and retrieve it from the cap with a brush or puff. Unused powder in the cap is poured back into the jar. The foregoing methods are both inconvenient and can be messy.

Accordingly, there is a need for a powder package capable of providing access to a portion of the contents without the inconvenience or mess of prior art designs.

BRIEF SUMMARY OF THE INVENTION

It is an object of the invention to provide a cosmetic container that conveniently provides access to a portion of the contents of the jar.

It is another object of the invention to provide a cosmetic container with convenient access to the product that avoids the problems of the prior art.

Accordingly, a sifter insert is provided for mounting in the neck of a powder jar above the product reservoir and below the cap of the jar. The sifter insert has a central concave dish portion for supporting a quantity of powder product. A channel is defined around the perimeter of the dish portion by an outer wall and inner wall. The outer wall secures the sifter insert in the opening in the neck of the jar such that the dish portion is spaced at a distance below the bottom side of the cap. In other words, there is a clearance between the dish portion and the underside of the cap. Slotted openings in the channel, in either the inner wall or outer wall of the sifter, permit the flow of powder from the product reservoir into the channel and subsequently through the clearance when the jar is inverted. When the inverted jar is righted, a quantity of powder that has passed through the clearance is deposited on the dish portion where it is accessible to the user upon removal of the cap from the jar. A powder brush or puff may be used to retrieve powder from the quantity deposited in the dish portion. When the user has finished retrieving powder product from the dish portion, the cap can be secured to the jar, and the jar can be shaken to return excess product from the dish portion to the product reservoir through the slots.

DETAILED DESCRIPTION OF THE INVENTION

Figure 1:
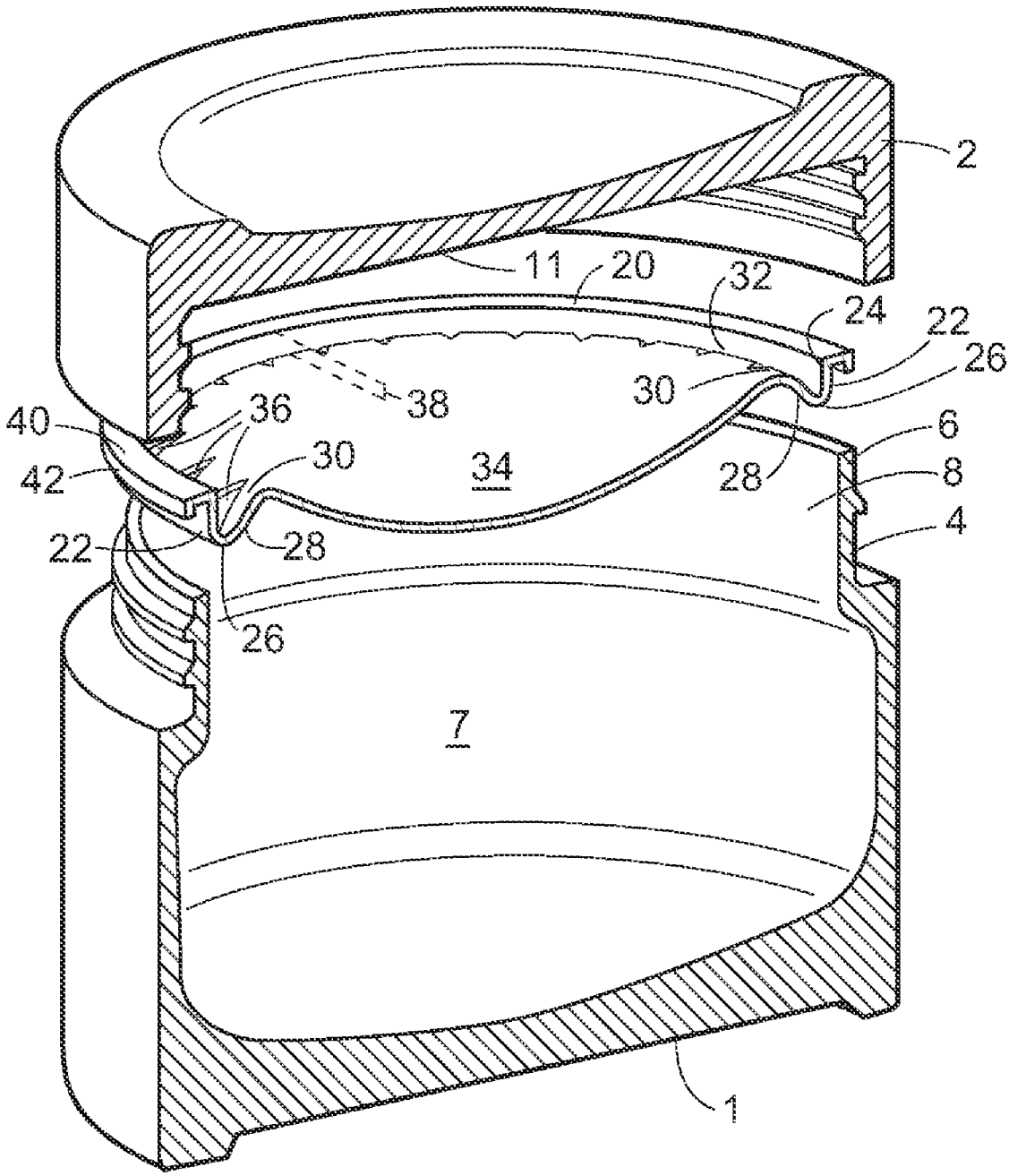
FIG. 1 is a perspective, cross-sectional and exploded view of the cosmetic package of the present invention.
Figure 2:
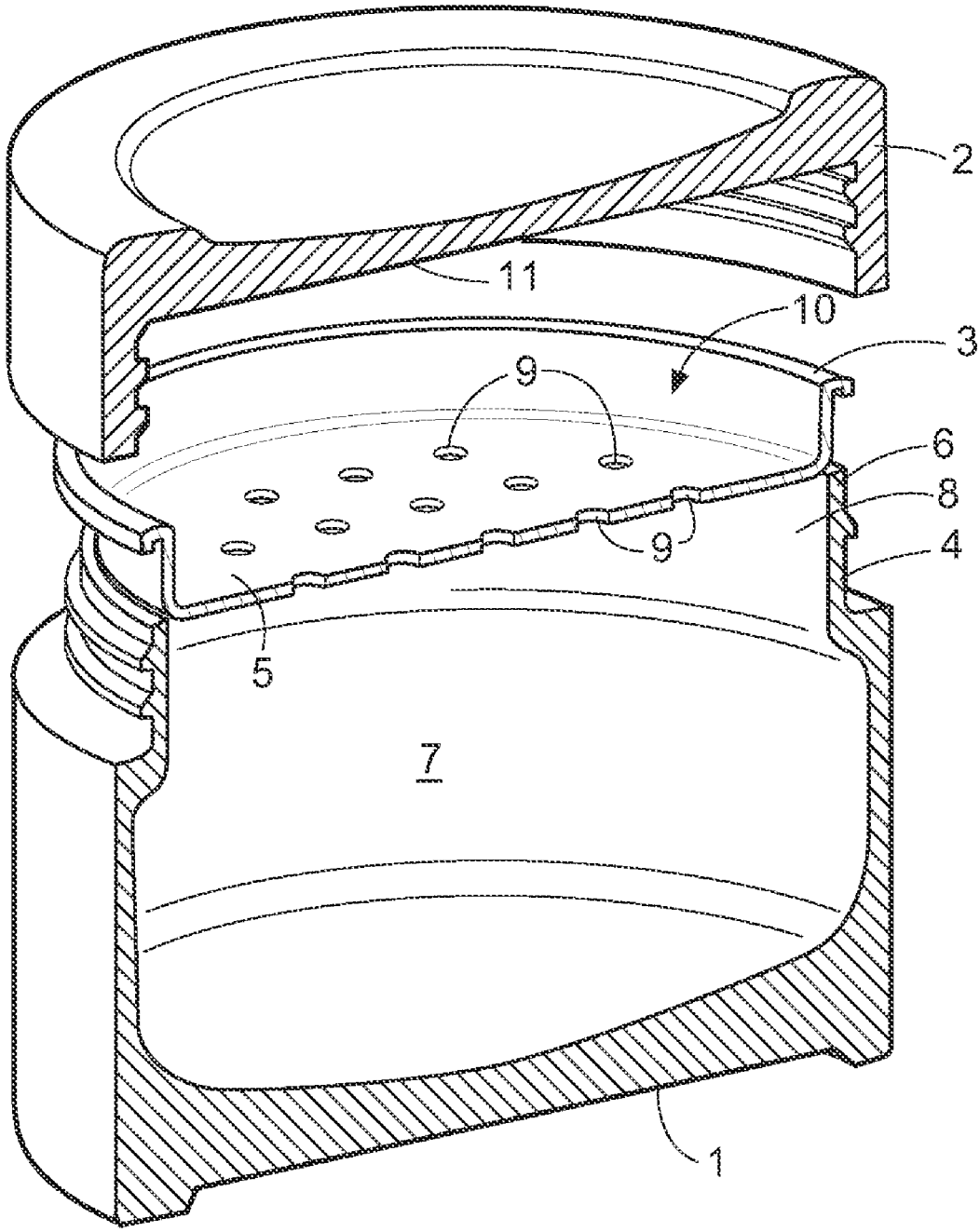
FIG. 2 Prior Art
FIG. 2 is a perspective, cross-sectional and exploded view of the prior art.

Referring now to FIG. 1, a jar 1 is shown made of plastic, metal or glass, with a threaded neck 4. Also provided is a cooperatively threaded plastic or metal cap 2 that can be screwed onto the neck 4 as a closure. The jar defines a product reservoir 7. The neck 4 defines an opening 8 that provides access to the product reservoir 7. The neck 4 has an upper edge 6. The cap 2 has a bottom side 11.

A sifter insert 20 is dimensioned to be received in the opening 8. The insert 20 has an outer perimeter wall 22 adapted to support the insert 20 in the opening 8 of the jar 1. The insert 20 can be secured by, for example, friction fit or press fit in the opening 8. The outer perimeter wall 22 depends from a top end 24 to a bottom end 26. An inner perimeter wall 28 extends upwardly from the bottom end 26 of the outer perimeter wall 22 to an upper end 30. A perimeter channel 32 is defined between the outer perimeter wall 22 and the inner perimeter wall 28.

A concave dish portion 34 is supported by the upper end 30 of the inner perimeter wall 28. The dish portion 34 is adapted to receive and hold a quantity of powder (not shown). The sifter insert 20 is adapted to be secured in the neck 4 such that the dish portion 34 is supported at a predetermined distance below the bottom side 11 of the cap 2 to create a clearance between the upper end 30 of the inner perimeter wall 28 and the bottom side 11 of the cap 2. This may be accomplished by a cap that is domed (not shown). In the embodiment shown, this is accomplished by defining a first distance between the top end 24 and the bottom end 26 of the outer perimeter wall 22, and defining a second distance that is less than the first distance between the bottom end 26 of the outer perimeter wall 22 and the upper end 30 of the inner perimeter wall 28. In other words, the outer perimeter wall 22 is taller than the inner perimeter wall 28 so that the upper end 30 of the inner perimeter wall is relatively lower than the top end 24 of the outer perimeter wall 22 (the height differential or clearance is indicated by the broken lines at reference number 38). When the top end 24 of the outer perimeter wall 22 is approximately at the same height as the upper edge 6 of the neck 4, the upper end 30 of the inner perimeter wall 28 is positioned at a point below the edge 6. The predetermined distance that the pan portion 34 sits below the bottom side 11 of the cap 2 must be sufficient to accommodate, for example, a cap with a bottom side that projects into the opening (not shown). The clearance 38 provides fluid communication between the channel 32 and the dish portion 34 of the insert 20.

A plurality of slots 36 is provided in the perimeter channel 32. Each slot 36 is located in at least one of the outer perimeter wall 22 or the inner perimeter wall 28. Each slot may straddle both the outer perimeter wall 22 and inner perimeter wall 28. A portion of a slot may extend into the pan portion 34 of the insert 20. Each slot 36 provides fluid communication between the perimeter channel 32 and the product storage reservoir 7 of the jar 1.

When the cap 2 is removed from the jar 1, and the jar 1 is inverted, powder can flow from the product reservoir 7 through the slots 36 onto any selected location, e.g., onto the user's skin, or onto a separate pan or dish, or onto an applicator such as a brush or a puff.

Preferably, to more effectively meter the powder for use and to avoid the mess and excess release of powder that can result from shaking powder directly from the jar onto separate surfaces, the cap 2 is initially kept securely closed on the jar 1. The closed jar 1 is inverted and powder flows from the product reservoir 7 through the slots 36 into the perimeter channel 32. The clearance 38 allows the flow of powder from the perimeter channel 32 to the dish portion 34 of the insert 20 as the jar 1 is subsequently righted. A quantity of powder is thus deposited and retained on the dish portion 34 where the user can access it with a brush or puff after opening the cap 2. When the user has finished accessing the powder deposited on the dish portion 34, the cap 2 is again secured on the jar 1 and the process is reversed to return the powder to the product reservoir 7. The clearance 38, perimeter channel 32 and slots 36 allow the powder to be returned to the product reservoir 7 from the dish portion 34 with a simple shake of the closed jar 1.

The outer perimeter wall 22 may be adapted to support the insert 20 in the opening 8 of the jar 1 by way of a horizontal rim 40 extending outwardly from the top end 24 of the outer perimeter wall 22. The rim 40 may be provided with a depending skirt wall 42. The top end 24 of the outer perimeter wall 22, the rim 40 and the skirt wall 42 thus form a structure that overlaps the upper edge 6 of the neck 4. This overlapping structure anchors the insert 20 securely in the opening 8 and indexes the predetermined clearance 38. The rim 40 can also act as a seal between the upper edge 6 of the neck 4 of the jar 1 and the bottom side 11 of the cap 2.

Each of the plurality of slots 36 can be any suitable shape. For example, each slot can be a triangle, a circle, an oval, a square or a rectangle. The insert 20 is preferably molded from a suitable plastic material, preferably by injection molding. Alternatively, it can also be made from machined or stamped metal. The slots 36 can be molded into the insert 20 by providing appropriate structure in the injection molding cavities. Alternatively, the slots 36 can be formed after the insert 20 is made by, for example, machining, punching, grinding, cutting, etc.

The insert 20 is suitable for use with powders such as face powders, body powders, etc.

It is understood that various modifications and changes in the specific form and construction of the various parts can be made without departing from the scope of the following claims.

What is claimed is:

1. A sifter insert for mounting in a powder jar, the powder jar having an opening and a product storage reservoir, the insert comprising:

an outer perimeter wall adapted to support the insert in the opening of the jar, the outer perimeter wall depending from a top end to a bottom end;

an inner perimeter wall extending upwardly from the bottom end of the outer perimeter wall to an upper end such that a perimeter channel is defined between the outer perimeter wall and the inner perimeter wall;

a concave dish portion supported within the upper end of the inner perimeter wall, the dish portion adapted to receive and hold a quantity of powder; and a plurality of slots each located in the perimeter channel in at least one of the outer perimeter wall or the inner perimeter wall and each providing fluid communication between the perimeter channel of the insert and the product storage reservoir of the jar.

2. The sifter insert of claim 1 wherein a first distance is defined between the top end and the bottom end of the outer perimeter wall, and a second distance that is less than the first distance is defined between the bottom end of the outer perimeter wall and the upper end of the inner perimeter wall.

3. The sifter insert of claim 1 wherein the outer perimeter wall is adapted to support the insert in the opening of the jar by way of a rim extending outwardly from the top end.

4. The sifter insert of claim 3 wherein the rim further comprises a depending skirt wall.

5. The sifter insert of claim 1 wherein each of the plurality of slots comprises a shape selected from one of a triangle, a circle, an oval, a square or a rectangle.

6. A powder package comprising:

a jar defining a product storage reservoir, the jar having a threaded neck defining an opening;

a cap cooperatively threaded to be received on the neck to selectively close the opening, the cap having a bottom side; and a sifter insert for mounting in the opening, the insert comprising:

an outer perimeter wall adapted to support the insert in the opening of the jar, the outer perimeter wall depending from a top end to a bottom end;

an inner perimeter wall extending upwardly from the bottom end of the outer perimeter wall to an upper end such that a perimeter channel is defined between the outer perimeter wall and the inner perimeter wall;

a concave dish portion supported within the upper end of the inner perimeter wall, the dish portion adapted to receive and hold a quantity of powder; and a plurality of slots each located in the perimeter channel in at least one of the outer perimeter wall or the inner perimeter wall and each providing fluid communication between the perimeter channel of the insert and the product storage reservoir of the jar;

wherein when the cap is secured on the neck, a clearance is provided between the bottom side of the cap and the upper end of the inner perimeter wall, the clearance providing fluid communication between the perimeter channel and the dish portion.

* * * * *